US010478960B2

(12) United States Patent
Hecht et al.

(10) Patent No.: US 10,478,960 B2
(45) Date of Patent: Nov. 19, 2019

(54) HANDHELD MACHINE TOOL HAVING A SPINDLE-LOCKING DEVICE

(71) Applicant: Robert Bosch GmbH, Stuttgart (DE)

(72) Inventors: Joachim Hecht, Magstadt (DE); Marco Braun, Stuttgart-Feuerbach (DE); Heiko Roehm, Stuttgart (DE); Stefan Mock, Remshalden (DE)

(73) Assignee: Robert Bosch GmbH, Stuttgart (DE)

( * ) Notice: Subject to any disclaimer, the term of this patent is extended or adjusted under 35 U.S.C. 154(b) by 1085 days.

(21) Appl. No.: 14/314,754

(22) Filed: Jun. 25, 2014

(65) Prior Publication Data

US 2015/0000951 A1 Jan. 1, 2015

(30) Foreign Application Priority Data

Jun. 26, 2013 (DE) ..... 10 2013 212 196

(51) Int. Cl.
*B25F 5/00* (2006.01)

(52) U.S. Cl.
CPC ..... *B25F 5/00* (2013.01)

(58) Field of Classification Search
CPC ..... H02K 11/33; B25B 21/00
USPC ..... 173/213, 217, 48
See application file for complete search history.

(56) References Cited

U.S. PATENT DOCUMENTS 5,525,842 A * 6/1996 Leininger ..... B23B 31/02 290/43
6,311,787 B1 * 11/2001 Berry ..... B25F 5/001 173/176
6,497,316 B1 12/2002 Hsu
6,702,090 B2 * 3/2004 Nakamura ..... B25F 5/001 173/217
7,063,201 B2 * 6/2006 Nakamura ..... B25F 5/001 173/217
7,900,713 B2 * 3/2011 Chen ..... B23B 45/008 173/178
2002/0130007 A1 9/2002 Nakamura et al.
2007/0181322 A1 * 8/2007 Hansson ..... B25F 5/001 173/217

FOREIGN PATENT DOCUMENTS

CN 1437522 A 8/2003
CN 102164715 A 8/2011
CN 103153549 A 6/2013

* cited by examiner

*Primary Examiner* — Andrew M Tecco
*Assistant Examiner* — Eyamindae C Jallow
(74) *Attorney, Agent, or Firm* — Norton Rose Fulbright US LLP; Gerard Messina

(57) ABSTRACT

In a handheld machine tool having a tool housing, in which a drive motor is situated for driving a drive element equipped with at least one clamping surface, to which a spindle-locking device equipped with a blocking element and at least one spindle cylinder is assigned, the at least one spindle cylinder being able to be clamped in a spindle-lock operation of the spindle-locking device between the at least one clamping surface and the blocking element to prevent the drive element from rotating relative to the tool housing, wherein a positioning element associated with the spindle locking device is situated at least in sections on the at least one clamping surface, the positioning element being situated at least partially in the region between the at least one spindle cylinder and the at least one clamping surface.

15 Claims, 5 Drawing Sheets

HANDHELD MACHINE TOOL HAVING A SPINDLE-LOCKING DEVICE

RELATED APPLICATION INFORMATION

The present application claims priority to and the benefit of German patent application no. 10 2013 212 196.2, which was filed in Germany on Jun. 26, 2013, the disclosure of which is incorporated herein by reference.

FIELD OF THE INVENTION

The present invention relates to a handheld machine tool having a tool housing, in which a drive motor is situated for driving a drive element equipped with at least one clamping surface, to which a spindle-locking device equipped with a blocking element and at least one spindle cylinder is assigned, the at least one spindle cylinder being able to be clamped between the at least one clamping surface and the blocking element when the spindle-locking device is in spindle-lock operation in order to prevent the drive element from rotating relative to the tool housing.

BACKGROUND INFORMATION

A handheld machine tool of this type is known from the related art, which has a drive motor situated in a tool housing for driving a drive element, e.g. a drive spindle, equipped with a spindle-locking device. The spindle-locking device has two or more spindle cylinders, which are able to be clamped between associated clamping surfaces of the drive spindle and a blocking element, developed e.g. in the manner of a clamping ring, when the handheld machine tool is in spindle-lock operation, or when the drive motor is switched off, in order to prevent the drive spindle from rotating relative to the tool housing. Particularly in single-sleeve chucks situated on the drive spindle, this allows for the chuck to be opened and closed using only one hand as well as for performing a ratchet operation.

The related art has the disadvantage that spindle-locking devices of this type display non-uniform response behavior in different handheld machine tools, it being possible for a respective torsion angle of the drive spindle, when triggering a corresponding spindle-lock operation, to be between 6° and more that 360°, depending on a respective machine position and a time duration of a corresponding braking process of the drive spindle prior to triggering the spindle-lock operation. In addition, spindle-lock devices of this type may display a so-called "rattling tendency" due to a great moment of inertia of the respective drive spindle, particularly when using comparatively heavy tool inserts, it being possible for the spindle-locking devices to enter at least briefly into an intermittent spindle-lock operation in particular when the drive spindle is running down. This may result in an undesired noise generation.

SUMMARY OF THE INVENTION

One objective of the present invention therefore is to provide a new handheld machine tool having a spindle-locking device, which has an improved response behavior and an at least reduced tendency to rattle.

This objective is achieved by a handheld machine tool having a tool housing, in which a drive motor is situated for driving a drive element equipped with at least one clamping surface, to which a spindle-locking device equipped with a blocking element and at least one spindle cylinder is assigned. In spindle-lock operation of the spindle-locking device, the at least one spindle cylinder is lockable between the at least one clamping surface and the blocking element in order to prevent the drive element from rotating relative to the tool housing. A positioning element assigned to the spindle-locking device is situated at least in sections on the at least one clamping surface, the positioning element being situated at least partially in the region between the at least one spindle cylinder and the at least one clamping surface.

The present invention thus allows for the provision of a handheld machine tool having a spindle-locking device, which has only a single additional component in comparison to conventional spindle-locking devices and in which by positioning the at least one spindle cylinder using the positioning element in proximity to the blocking element, but not necessarily touching the latter, it is possible to improve at least a respective response behavior of the spindle-locking device in spindle-lock operation independently of the respective spatial position of the handheld power tool, without affecting a total efficiency of the handheld machine tool. In addition, the tendency of the spindle-locking device to rattle may be significantly reduced. In this connection, a respective influence of manufacturing tolerances, gravity, magnetism and/or grease adhesion is at least reduced and may be minimized in the response of the spindle-locking device.

According to one specific embodiment, the positioning element has a viscoelastic ring.

It is thus possible to provide a simple and cost-effective positioning element.

The viscoelastic ring may be situated at least in sections in a groove, in particular an annular groove, developed on the drive element.

The viscoelastic ring may thus be situated in a simple manner at least in sections in an area between the at least one spindle cylinder and the at least one clamping surface.

The viscoelastic ring may have a circular cross section having a diameter of maximally 3 mm.

It is thus possible to provide a robust and cost-effective viscoelastic ring.

The viscoelastic ring may be developed in the manner of an O-ring, which is situated coaxially on the drive element.

The viscoelastic ring may thus be fixed securely and reliably in the region between the at least one spindle cylinder and the at least one clamping surface.

According to one specific embodiment, the blocking element is developed annularly in the manner of a clamping ring.

The present invention thus allows for the provision of a handheld machine tool that has a spindle-locking device having an uncomplicated and stable blocking element.

According to one specific embodiment, the viscoelastic ring has an outer diameter that is greater than or equal to or maximally 10% smaller than the difference between an inner diameter of the blocking element and double the outer diameter of the at least one spindle cylinder.

The present invention thus allows for the provision of a handheld machine tool having a spindle-locking device, in which a positioning of the at least one spindle cylinder in proximity to the blocking element using the positioning element may be ensured in a simple manner.

The at least one clamping surface may be developed to be at least essentially flat.

The clamping surface may thus be developed in a simpler, quicker and thus more cost-effective manner.

The drive element may be a drive spindle drivable by the drive motor.

In a simple and cost-saving manner, it is thus possible to do without the use of additional torque transmission elements for example.

According to one specific embodiment, the drive element is a sleeve-shaped drive element, which is supported on a drive spindle that is drivable by the drive motor.

The present invention may thus be applied also in handheld machine tools, in which additional torque transmission elements are used for transmitting a drive torque produced by the drive motor to the drive spindle.

The present invention is explained in greater detail in the following description on the basis of exemplary embodiments illustrated in the drawings.

DETAILED DESCRIPTION

Figure 1:
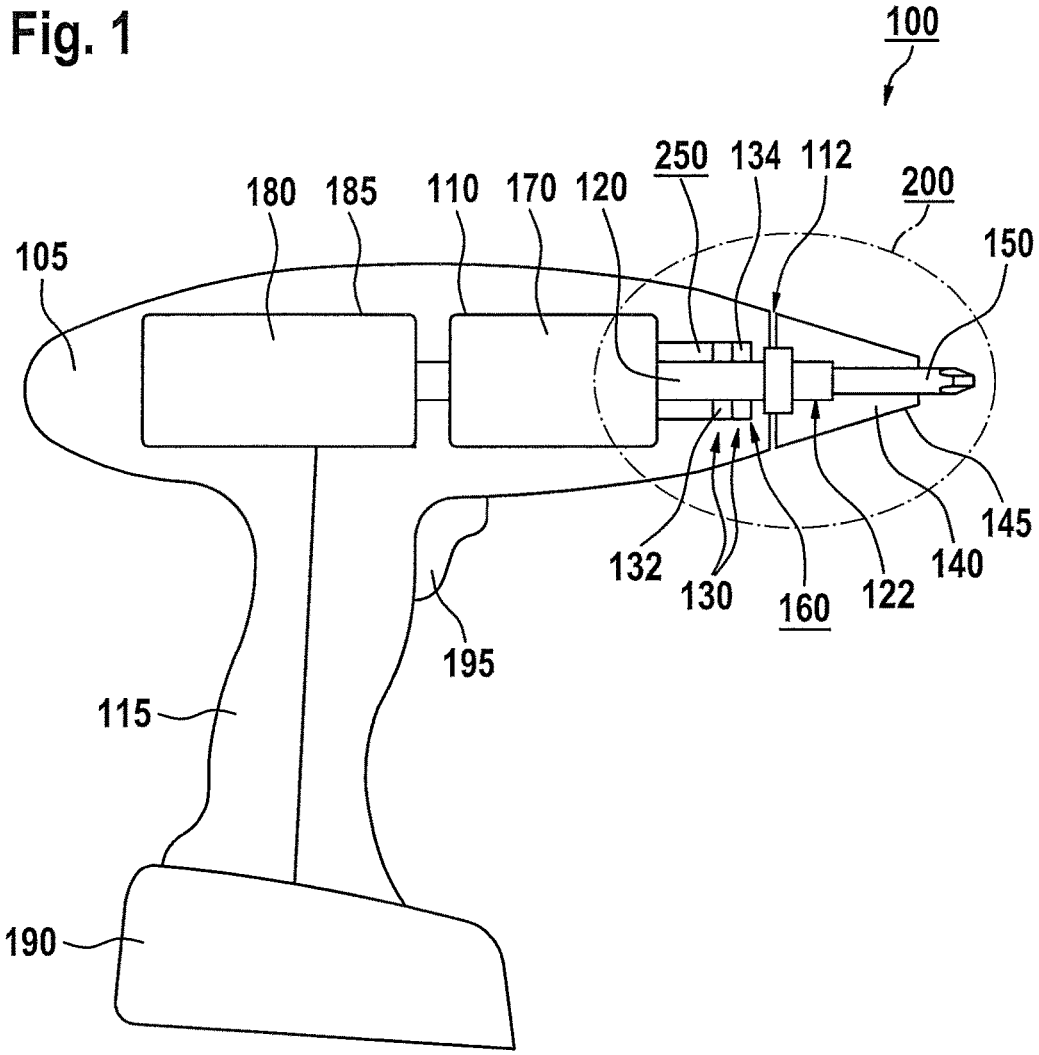
FIG. 1 shows a schematic view of a handheld machine tool according to the present invention.

FIG. 1 shows a handheld machine tool 100 equipped with an optional torque clutch 160, which has a tool housing 105 having a handle 115. At least one drive motor 180 is situated in tool housing 105 for driving a drive element 120 connected to a tool holder 140, to which a spindle-locking device 250 is assigned.

According to one specific embodiment, handheld machine tool 100 is developed in the manner of a manually guided power tool and is able to be connected, mechanically and electrically, to a rechargeable battery pack 190 for a network-independent supply of current. In FIG. 1, handheld machine tool 100 is developed as a battery-operated screwdriver by way of example. It should be noted, however, that the present invention is not limited to manually guided power tools and in particular battery-operated drills, but rather may be used in various handheld machine tools, which have a drive element equipped with a spindle-locking device, regardless of whether these handheld machine tools are operated electrically, i.e. by battery or mains, or are operated non-electrically.

In handheld machine tool 100, battery pack 190 supplies current to drive motor 180, which is developed in exemplary fashion as an electric motor. Drive motor 180, for example, is able to be operated, that is, switched on and off, via a manual switch 195, and may be of any desired motor type, for example, an electronically commutated motor or a DC motor.

Drive motor 180 may be controllable or regulatable electronically in such a way that both a reversing operation and specifications regarding a desired rotational speed are able to be implemented. The method of functioning and the configuration of a suitable drive motor are sufficiently known from the related art so that a detailed description is omitted here for the sake of brevity of description.

Drive motor 180 is connected to drive element 120 via a transmission 170 situated in tool housing 105. Drive motor 180 may be situated in a motor housing 185 and transmission 170 in a transmission housing 110, transmission housing 110 and motor housing 185 being situated in exemplary fashion in tool housing 105.

Transmission 170 is developed to transmit a torque generated by drive motor 180 to drive element 120 and is merely by way of example, but not necessarily, a planetary transmission developed having different gear or planetary stages, which is driven in rotary fashion by drive motor 180 when handheld machine tool 100 is in operation. Planetary transmission 170 will be described below with reference to a sectional view, shown enlarged in FIG. 2, of a section 200. It should be noted, however, that it is also possible to omit the provision of transmission 170, depending on a selected configuration of drive motor 180.

Via a bearing system 130, drive element 120 is rotatably supported in tool housing 105 and connected to tool holder 140, which is located in the region of an end face 112 of tool housing 105 and includes a drill chuck 145 by way of example. According to one specific embodiment, bearing system 130 has at least two bearing points 132, 134, which are provided in tool housing 105 in a region downstream from transmission 170. Tool holder 140 accommodates a tool insert 150 and may be integrally formed on drive element 120 or may be joined to the latter in the form of an attachment. In FIG. 1, for example, tool holder 140 is developed as an attachment and fastened on drive element 120 via a fastening device 122 provided on the latter.

According to one specific embodiment, drive element 120 is associated, as described above, with spindle-locking device 250, which is developed at least to prevent drive element 120 from rotating relative to tool housing 105 in spindle-lock operation. In this instance, spindle-locking device 250 may be triggered upon rotating drive element 120 in any direction or only upon rotating it in a specified direction.

Spindle-locking device 250 is situated, in exemplary fashion, in the axial direction of drive element 120 between transmission 170 and the two bearing points 132, 134, but alternatively may also be situated at another suitable position, e.g. between bearing points 132, 134, in transmission 170 or between transmission 170 and drive motor 180. The manner of functioning of spindle-locking devices is sufficiently known from the related art such that for the sake of keeping the description brief, a detailed description of the manner of functioning of spindle-locking device 250 is omitted.

Figure 2:
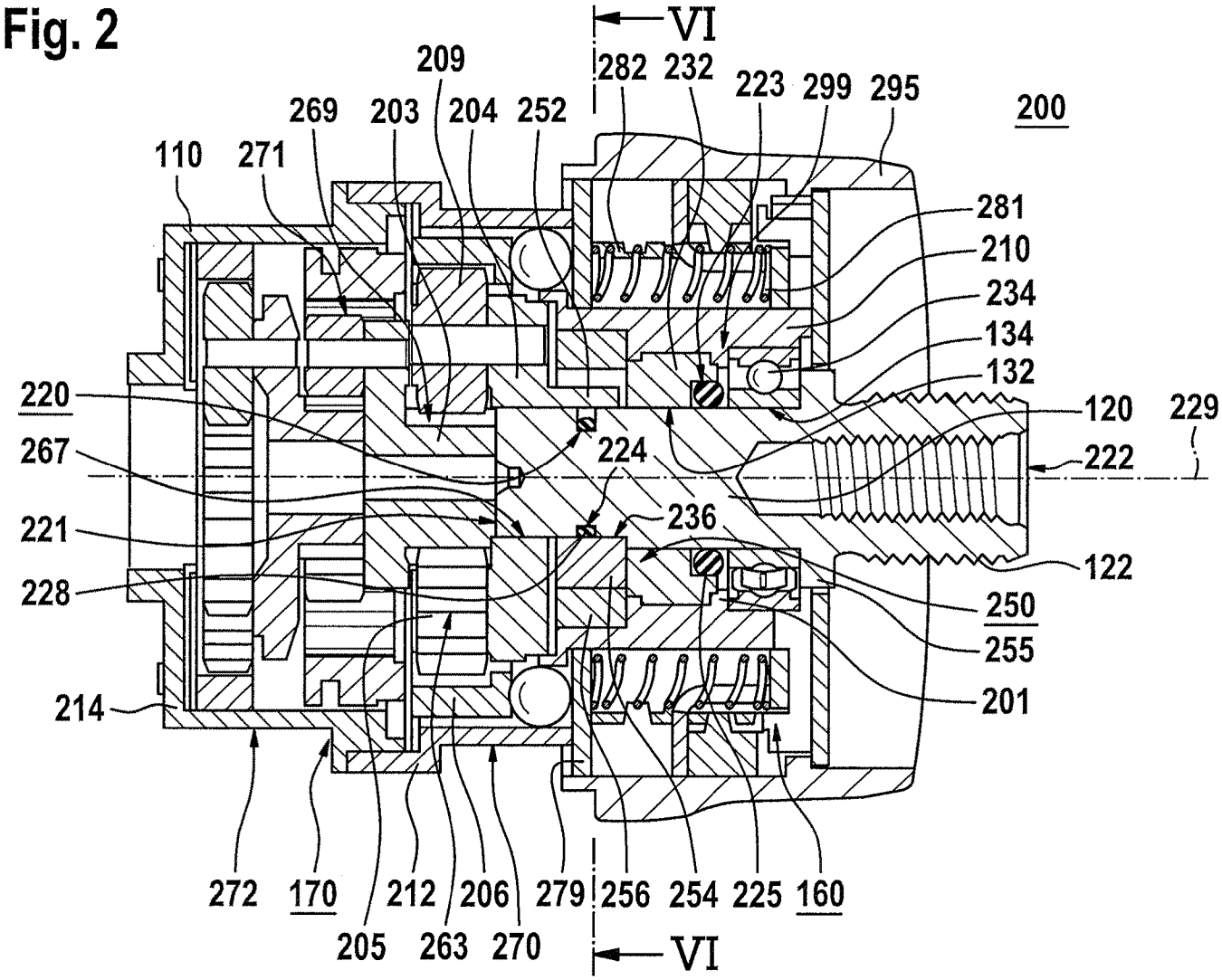
FIG. 2 shows an enlarged sectional view of a section of the handheld machine tool from FIG. 1 including a drive element, according to a first specific embodiment.

FIG. 2 shows section 200 of handheld machine tool 100 from FIG. 1, in which an illustration of tool insert 150 and tool holder 140 from FIG. 1 was omitted for the sake of clarity and simplicity of the drawing. Section 200 illustrates an exemplary development of planetary transmission 170, of drive element 120, bearing points 132, 134 as well as of spindle-locking device 250 developed in accordance with a first specific embodiment.

Planetary transmission 170 is able to be switched at least between a first and a second gear and has, by way of example, three gear or planetary stages: a front stage 270, a center stage 271 and a rear stage 272. Front planetary stage 270, for example, has a sun wheel 203 having gear teeth 269, at least one first planetary wheel 209 as well as a second planetary wheel 205 having gear teeth 263, a planetary carrier 204 having a rotary slaving contour 267, and an annular gear 206. The torque of drive motor 180 from FIG. 1 is transmitted to drive element 120 via planetary stages 272, 271, 270 by the rotary slaving contour 267 of planetary carrier 204. Since the structure of a planetary transmission is sufficiently known to one skilled in the art, a further description of planetary stages 271, 272 is omitted for the sake of keeping the description brief.

Planetary stages 270, 271, 272 are situated, by way of example, in transmission housing 110, which may be developed as two pieces and which for purposes of illustration is divided into a front section 210, 212—on the right in FIG. 2—and a rear section 214—on the left in FIG. 2. Planetary stages 270, 271, 272 are situated in rear section 214 for purposes of illustration. Front section 210, 212 forms, by way of illustration, an input-side region 212 and an output-side region 210. A receptacle 201 is developed in exemplary fashion on the inner circumference of output-side region 210. An external thread 282 is illustratively developed on the outer circumference of output-side region 210, on which a torque setting sleeve 295 associated with optional torque clutch 160 is rotatably supported by way of example, which torque setting sleeve 295 is coupled with an annular limitation transmission element 279, which is impinged upon by a plurality of helical compression springs 281.

According to one specific embodiment, drive element 120 is a drive spindle supported on the two bearing points 132, 134 so as to be rotatable about an axis of rotation 229, which has an input-side axial end 221 and an output-side axial end 222. It should be noted, however, that drive element 120 may also be developed as a sleeve-shaped drive element for example, instead of a drive spindle, as described in FIG. 7. A friction bearing 232, e.g. a sintered bearing, situated at least in sections in U-shaped receptacle 201, is provided by way of example on bearing point 132, and a roller bearing 234, e.g. a ball bearing, is provided on bearing point 134, the sintered bearing 232 and the ball bearing 234 illustratively being spaced apart from each other by an optional O-ring 225 and being situated in a region 299 downstream from transmission 170. O-ring 225 is situated, by way of example, in a recess 223 provided on sintered bearing 232 and may implement at least one sealing function between sintered bearing 232 and drive spindle 120.

Drive spindle 120 illustratively has a support flange 255 as well as fastening device 122 developed as an external thread, on which tool holder 140 from FIG. 1 is able to be fastened. Spindle-locking device 250 may be located in the region of the input-side axial end 221 of drive spindle 120. Spindle-locking device 250 has a carrier element 252 supported on drive spindle 120 with a specified radial play, which in this case is developed in one piece with planetary carrier 204, by way of example, and on which at least one spindle cylinder 254 is situated. The at least one spindle cylinder 254 is supported in a blocking element 256, which is likewise associated with spindle-locking device 250 and is developed to prevent the at least one spindle cylinder 254 from sliding out of carrier element 252 in the radial direction of drive spindle 120. In spindle-lock operation of spindle-locking device 250, the at least one spindle cylinder 254 is able to be clamped between blocking element 256 and at least one clamping surface 236 which may be configured to be at least approximately flat on the input-side axial end 201 of drive spindle 120 in order to prevent drive spindle 120 from rotating relative to transmission housing 110 and thus relative to tool housing 105 from FIG. 1.

Blocking element 256 is developed e.g. in annular fashion in the manner of a clamping ring and is connected at least indirectly—with or without a specified play—in a rotatably fixed manner to tool housing 105. In the context of the present invention, the term "clamping ring" denotes an at least sectionally annular component having a cylindrical inner circumference or a circular cross section, the at least one spindle cylinder 254 being able to be clamped on the inner circumference.

By way of illustration, blocking element 256 is situated in a rotatably fixed manner in the output-side region 210 of transmission housing 110, it being possible for a corresponding play to exist, within specified tolerances, in the axial, radial and/or circumferential direction. Alternatively, blocking element 256 may be connected without play to transmission housing 110, developed in one piece with transmission housing 110, or be molded onto the latter e.g. by plastic extrusion coating. For illustrative purposes, blocking element 256 and spindle cylinder 254 have, at least within specified tolerances, matching axial dimensions such that spindle cylinder 254 is situated in the region between planetary carrier 204 and sintered bearing 232 and is thus axially fixed in place on drive spindle 120.

According to one specific embodiment, spindle-locking device 250 has a positioning element 220, which is developed to impinge on the at least one spindle cylinder 254 in the direction of blocking element 256 in order to allow for the at least one spindle cylinder 254 to be positioned in proximity to the blocking element at least in normal operation and in the state of rest of handheld machine tool 100 from FIG. 1. For this purpose, positioning element 220 is situated at least partially in the region between the at least one spindle cylinder 254 and the at least one clamping surface 236, and at least in sections on the at least one clamping surface 236. In this instance, positioning element 220 projects beyond the at least one clamping surface 236 at least in regions in the direction of blocking element 256 and thereby may form approximately at the center on the clamping surface 236 a high point or a maximal projection as seen in the circumferential direction of drive spindle 120.

Positioning element 220 may be formed by a viscoelastic ring 228, in particular an O-ring. This viscoelastic ring 228 may be situated at least in sections in a groove 224, in particular an annular groove, developed on drive element 120. Viscoelastic ring 228 may be situated coaxially on drive element 120 or on its outer circumference.

According to one specific embodiment, viscoelastic ring 228 has a circular cross section having a diameter of maximally 3 mm, but may alternatively also have any other cross section, e.g. triangular, quadrangular etc. The outer diameter of viscoelastic ring 228 may be greater than or equal to a difference of an inner diameter of blocking element 256 and two times an outer diameter of the at least one spindle cylinder 254. For this purpose, the outer diameter of viscoelastic ring 228 may also be up to maximally 10% smaller than said difference. NBR, HNBR, EPDM, TPE or FPM may be used for example as the viscoelastic material for developing viscoelastic ring 228 or a viscoelastic material may be used that generally has a Shore A material hardness of at least 60 to 95.

Figure 3:
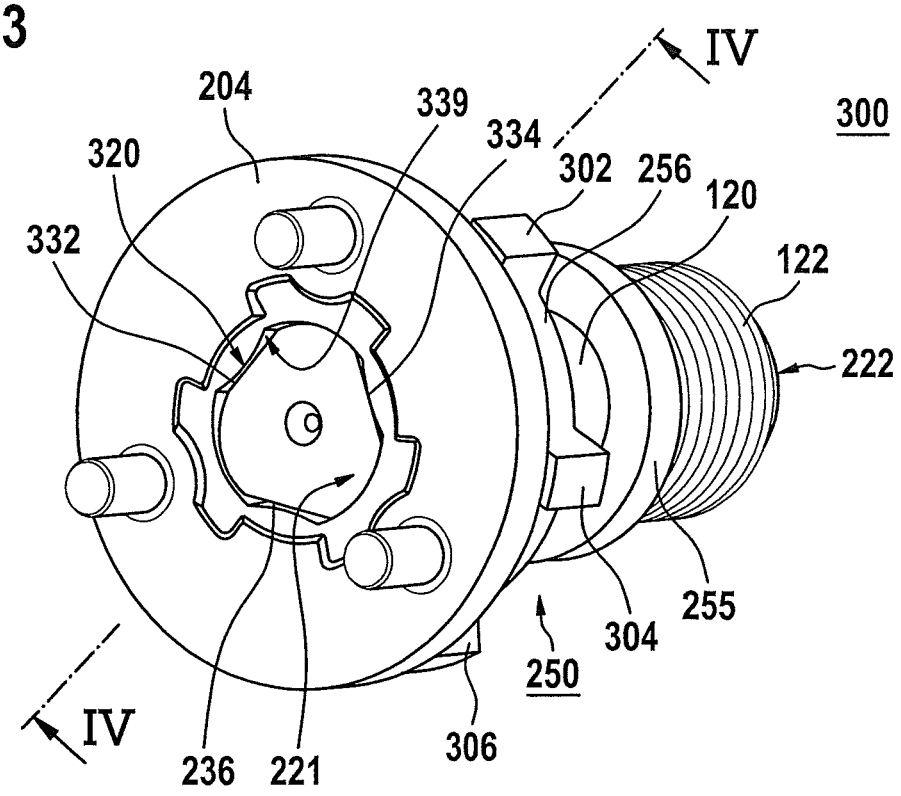
FIG. 3 shows a perspective rear view of a system including the drive spindle and the spindle-locking device from FIG. 2.

FIG. 3 shows a system 300 having planetary carrier 204, drive spindle 120 equipped with support flange 255 and fastening device 122, and spindle-locking device 250 from FIG. 2. As described in FIG. 2, the latter has the clamping surface 236 developed on the input-side axial end 221 of drive spindle 120 and blocking element 256, which is provided at least with one and may be with a plurality of radial extensions, three extensions being shown here by way of illustration, which are marked with reference numerals 302, 304, 306.

As described above, drive spindle 120 is supported with its input-side axial end 221 in a rotationally fixed manner, but with a specified radial play 339, on planetary carrier 204 and forms together with the latter at least one form-locking connection 320 in order thus to allow for a torque transmission from planetary carrier 204 to drive spindle 120 in the normal operation of handheld machine tool 100 from FIG. 1. For this purpose, two additional clamping surfaces 332, 334 are provided in addition to clamping surface 236 on input-side axial end 221 of drive spindle 120. Clamping surfaces 236, 332, 334 are developed in the manner of at least approximately plane flats.

Figure 4:
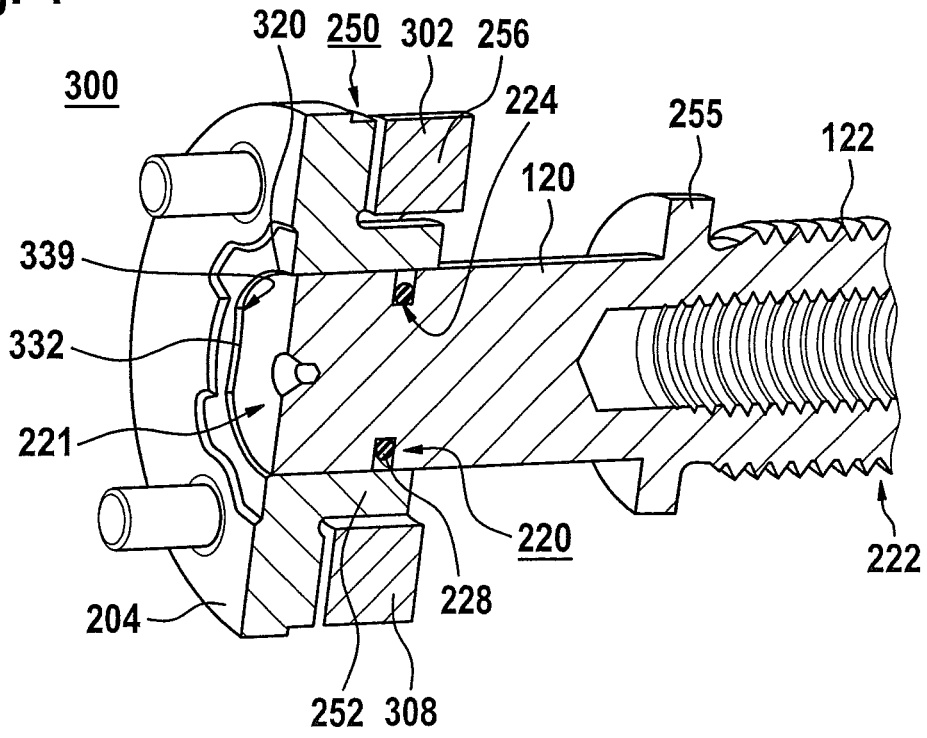
FIG. 4 shows a perspective, partially sectional view of the system from FIG. 3.

FIG. 4 shows system 300 from FIG. 3 to illustrate the form-locking connection 320 and the radial play 339 between planetary carrier 204 and drive spindle 120 as well as to illustrate the viscoelastic ring 228 situated in annular groove 224 of drive spindle 120, which forms positioning element 220.

Figure 5:
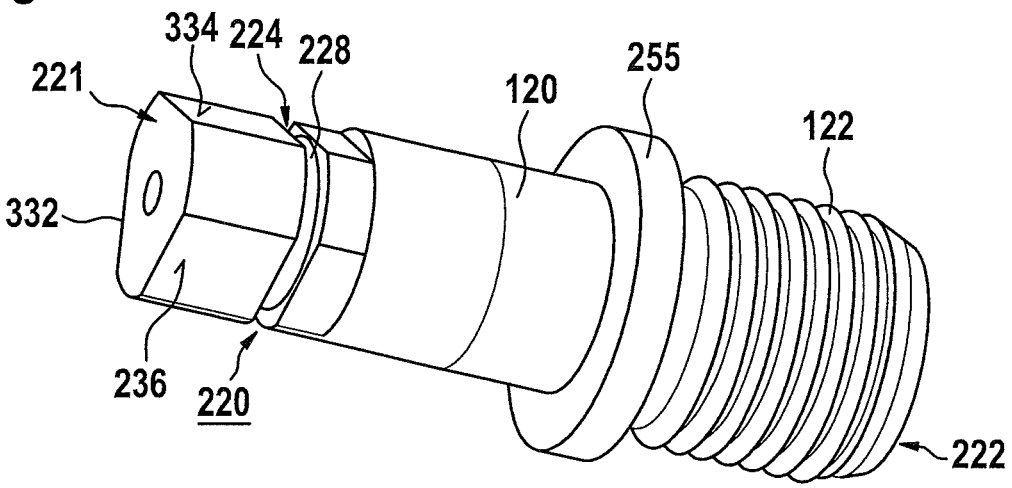
FIG. 5 shows a perspective view of the drive spindle from FIGS. 2 through 4.

FIG. 5 shows drive spindle 120 from FIGS. 2 through 4 to illustrate clamping surfaces 236, 332, 334 developed in the manner of at least approximately plane flats on input-side end 221 as well as to illustrate annular groove 224 developed in the region of clamping surfaces 236, 332, 334. The latter houses by way of example viscoelastic ring 228 from FIGS. 2 through 4, which for purposes of illustration has here an outer diameter indicated by reference numeral 697, which is approximately 10% smaller than the difference of an inner diameter of blocking element 256 indicated by reference numeral 699 and two times an outer diameter of the at least one spindle cylinder 254 from FIGS. 2 through 4 indicated by reference numeral 698.

Figure 6:
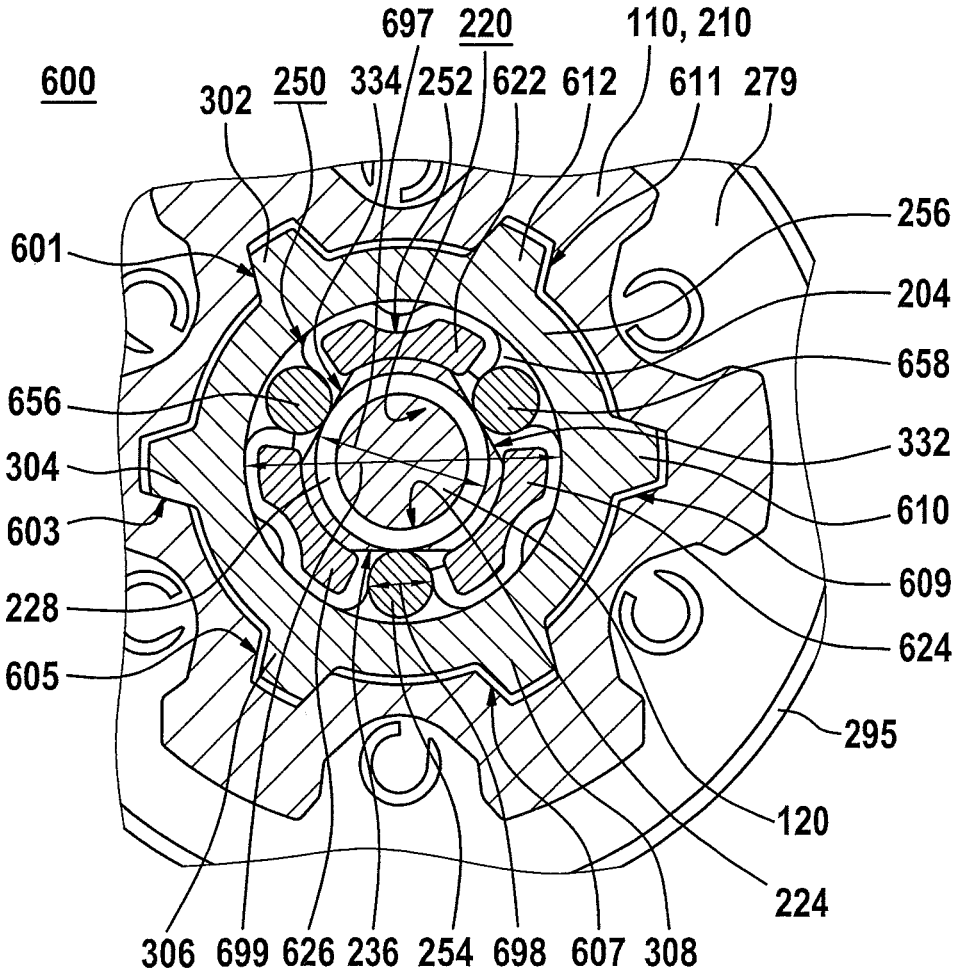
FIG. 6 shows a sectional view of the section of the handheld machine tool from FIG. 1, as seen in the direction of arrows VI from FIG. 2.

FIG. 6 shows a system 600 having torque setting sleeve 295, annular limiting transmission element 279, front section 210 of transmission housing 110, blocking element 256, the viscoelastic ring 228 forming positioning element 220 and situated in annular groove 224, carrier element 252 provided on planetary carrier 204, spindle cylinder 254 and drive spindle 120 from FIG. 2 for illustrating the manner of functioning of spindle-locking device 250 from FIGS. 1 through 4. Blocking element 256, by way of illustration, has the radial extensions 302, 304, 306 from FIG. 3 as well as three additional radial extensions 308, 610, 612, via which blocking element 256 is rotatably fixed, but may be at least with a specified play in the circumferential direction, in transmission housing 110. For this purpose, transmission housing 110 has associated receptacles 601, 603, 605, 607, 609, 611, which have greater dimensions in the circumferential direction of drive spindle 120 than radial extensions 302, 304, 306, 308, 610, 612. Carrier element 252 has, by way of illustration, three axially oriented cams 622, 624, 626, which are configured to entrain spindle cylinder 254 and two additional spindle cylinders 656, 658 in the normal operation of handheld machine tool 100 from FIG. 1, spindle cylinder 254 being situated, as described above, in the area of clamping surface 236 and spindle cylinders 656, 658 being situated in the areas of respectively associated clamping surfaces 334, 332.

According to one specific embodiment, spindle cylinders 254, 656, 658 are impinged upon by viscoelastic ring 228, as described above, in the direction of blocking element 256 so as to assume in spindle-locking device 250 a position that is at least in proximity to the blocking element, but not necessarily touching it. This impingement occurs in every operating state of handheld machine tool 100 from FIG. 1, i.e. both in normal operation as well as in spindle-lock operation, which is triggered when drive motor 180 from FIG. 1 is switched off by twisting drive spindle 120 into a specified direction of rotation.

Figure 7:
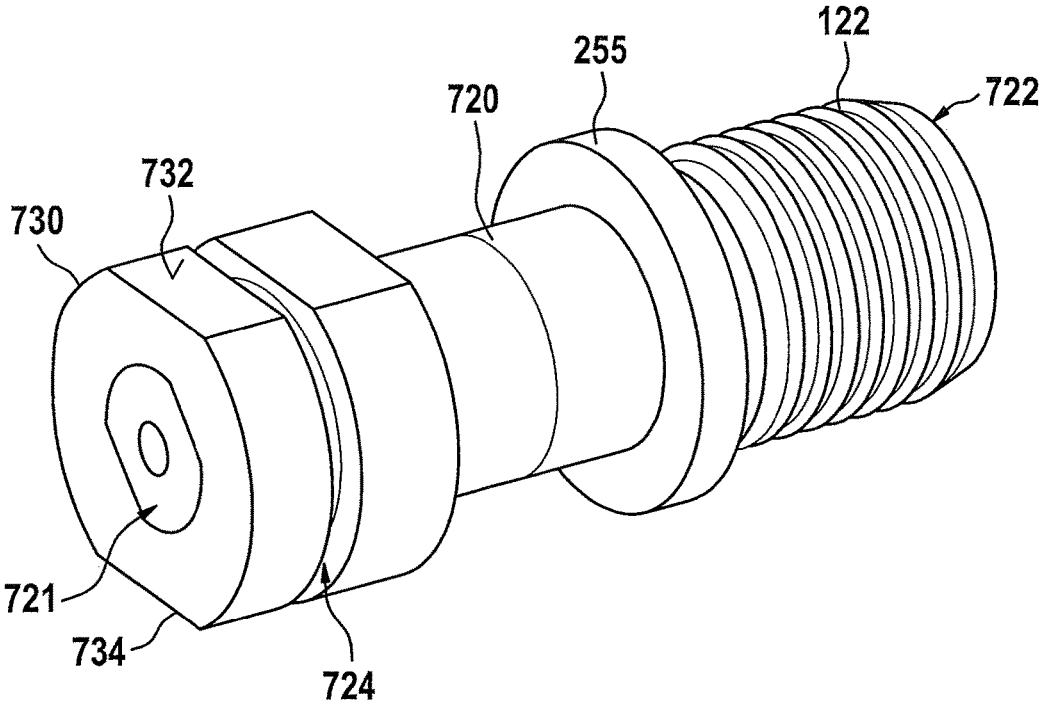
FIG. 7 shows a perspective view of a drive element according to a second specific embodiment.

FIG. 7 shows a drive element 730 according to a second specific embodiment, which may be used instead of drive element 120 from FIGS. 1 through 6 in an implementation of handheld machine tool 100 from FIG. 1. For the purpose of transmitting torque, drive element 730 is situated in a rotationally fixed manner on an associated drive spindle 720, which has an input-side axial end 721 and an output-side axial end 722, on which, by way of illustration, support flange 255 and fastening device 122 of drive element 120 from FIGS. 2 through 5 are developed.

According to the second specific embodiment, drive element 730 is situated at least in a form-locking and/or force-locking manner in the area of input-side axial end 721 of drive spindle 720. Drive element 730 may have at least two clamping surfaces 732, 734 and an annular groove 724 for receiving viscoelastic ring 228 from FIGS. 2 through 6.

What is claimed is:

1. A handheld machine tool, comprising:

a tool housing, in which a drive motor is situated for driving a drive element equipped with at least one clamping surface, to which a spindle-locking device is assigned that is equipped with a blocking element and at least one spindle cylinder, the at least one spindle cylinder being clampable in the spindle-lock operation of spindle-locking device radially between the at least one clamping surface and the blocking element within a plane that is perpendicular to a longitudinal axis of the machine tool to prevent the drive element from rotating relative to the tool housing; and a positioning element assigned to the spindle-locking device is situated at least in sections on the at least one clamping surface of the drive element, the positioning element being situated at least partially in the region radially between the at least one spindle cylinder and the at least one clamping surface, wherein the positioning element is configured to impinge on the at least one spindle cylinder in a direction of the blocking element, wherein the positioning element projects beyond the at least one clamping surface at least in regions in the direction of blocking element, thereby forming a maximal projection on the clamping surface when viewed in a circumferential direction of the drive element, wherein the positioning element is situated at least partially in the region radially between the at least one spindle cylinder and the at least one clamping surface within a plane that is perpendicular to the longitudinal axis of the machine tool.

2. The handheld machine tool of claim 1, wherein the positioning element has a viscoelastic ring.

3. The handheld machine tool of claim 2, wherein the viscoelastic ring is situated at least in sections in a groove on the drive element.

4. The handheld machine tool of claim 2, wherein the viscoelastic ring has a circular cross section having a diameter of maximally 3 mm.

5. The hand-held machine tool of claim 2, wherein the viscoelastic ring is configured as an O-ring, which is situated coaxially on the drive element.

6. The handheld machine tool of claim 1, wherein the blocking element is configured annularly in the manner of a clamping ring.

7. The handheld machine tool of claim 1, wherein the viscoelastic ring has an outer diameter that is greater than or equal to or maximally 10% smaller than the difference between an inner diameter of the blocking element and double an outer diameter of the at least one spindle cylinder.

8. The handheld machine tool of claim 1, wherein the at least one clamping surface is at least approximately flat.

9. The handheld machine tool of claim 1, wherein the drive element is a drive spindle drivable by the drive motor.

10. The handheld machine tool of claim 1, wherein the drive element is a sleeve-shaped drive element, which is supported on a drive spindle that is driveable by the drive motor.

11. The handheld machine tool of claim 2, wherein the viscoelastic ring is situated at least in sections in an annular groove on the drive element.

12. The hand-held machine tool of claim 1, wherein the spindle-locking device includes a plurality of spindle cylinders.

13. The hand-held machine tool of claim 1, wherein the drive element is supported in a rotationally fixed manner and with a specified radial play on a planetary carrier which provides torque transmission to the drive element.

14. The hand-held machine tool of claim 1, wherein the spindle-locking device includes a carrier element supported on the drive element with a specified radial play.

15. The hand-held machine tool of claim 14, wherein the carrier element is embodied in one piece with the planetary carrier.

* * * * *